United States Patent [19]

Humphrey

[11] Patent Number: 4,861,072

[45] Date of Patent: Aug. 29, 1989

[54] APPARATUS AND METHOD FOR CARRYING SKIS AND SKI POLES

[76] Inventor: Lloyd E. Humphrey, 9204 Dover Way, Broomfield, Colo. 80020

[21] Appl. No.: 221,205

[22] Filed: Jul. 19, 1988

[51] Int. Cl.[4] ..... A63C 11/02

[52] U.S. Cl. ..... 280/814; 224/917; 294/147

[58] Field of Search ..... 294/137, 146–149, 294/165, 166; 24/298, 299; 211/70.5; 224/917; 280/812, 814, 815, 820

[56] References Cited

U.S. PATENT DOCUMENTS

| | | | |
|---|---|---|---|
| 3,675,835 | 7/1972 | Wilson | 280/814 |
| 3,774,826 | 11/1973 | Raihill et al. | 294/147 |
| 4,134,182 | 1/1979 | Ramsby | 294/147 X |
| 4,175,683 | 11/1979 | Shields | 294/147 X |
| 4,364,585 | 12/1982 | Shields | 294/147 X |
| 4,630,842 | 12/1986 | Roda | 294/147 X |

FOREIGN PATENT DOCUMENTS

| | | | |
|---|---|---|---|
| 2509620 | 1/1983 | France | 280/820 |
| 54028 | 6/1934 | Norway | 280/814 |
| 185697 | 10/1936 | Switzerland | 280/814 |
| 185703 | 10/1936 | Switzerland | 280/812 |
| 562043 | 5/1975 | Switzerland | 280/820 |

*Primary Examiner*—Johnny D. Cherry
*Attorney, Agent, or Firm*—Dorr, Carson, Sloan & Peterson

[57] ABSTRACT

A pair of skis and ski poles can be carried by means of an apparatus having a fastener (e.g., a split ring or clip) that is secured to a first ski pole above the ski pole basket. An elongated member, such as a length of chain or flexible cord, is attached at one end to the fastener. A ring is attached to the other end of the elongated member that can be slipped over the tip of the second ski pole. The skis and poles are carried by first establishing a substantially parallel orientation of both ski poles with the elongated member extending between the ski poles. The skis are then placed perpendicularly through the opening between the poles until the toe bindings of the skis rest against the poles. The entire assembly is carried over the shoulder of the skier. The pole handles extend in front of the skier. The skis are held in a substantially vertical orientation between the back of the skier and the ski pole baskets.

4 Claims, 4 Drawing Sheets

APPARATUS AND METHOD FOR CARRYING SKIS AND SKI POLES

BACKGROUND OF THE INVENTION

1. Field of the Invention.

The present invention relates generally to the field of skiing equipment. More specifically, the present invention is a method and apparatus to allow a skier to more easily carry a pair of skis and ski poles.

2. Prior Art.

A large number of devices have been used to make carrying skis and ski poles more convenient. Skis and poles are also carried without the benefit of extra components simply by stacking the skis with their bottom faces together. The skis are carried over one shoulder and the poles are carried in the opposite hand. This approach has disadvantages of requiring the use of both hands, and presenting a danger to those nearby from the ski tips extending horizontally over the skier's shoulder. This approach is also not very comfortable for the skier. One type of carrying device uses either a clamping mechanism or straps to attach a handle and hold the skis and poles parallel to one another. The skis and poles are carried horizontally by one hand gripping the attached handle. This arrangements presents a danger to persons in front and behind the skier. Carrying devices of this type are also inconvenient in that the carrying device must be removed and stored separately while the skis are in use.

In contrast to the prior art, skis carried in accordance with the present invention are held in a safe, substantially vertical position using only one hand of the skier. When the skis are in use, the device can remain attached to one ski pole without interfering with skiing.

SUMMARY OF THE INVENTION

The present invention is a method and apparatus for carrying a pair of skis and ski poles. A fastener, such as a split ring or clip, is secured to a first ski pole above the ski pole basket. An elongated member, such as a length of chain or cord is attached at one end to the fastener. A ring is attached at the other end of the elongated member that can be slipped over the tip of the second ski pole. The skis and poles are carried by first establishing a substantially parallel orientation of both ski poles, with the elongated member extending between the poles. The skis are then placed perpendicularly through the opening between the poles with the toe bindings of the skis resting against the poles. The entire assembly is carried over the shoulder of the skier. The pole handles extend in front of the skier. The skis are held in a substantially vertical orientation between the back of the skier and the ski pole baskets.

A principal object of the present invention is to provide a method and apparatus to carry skis and poles that is simpler, less expensive, and safer than those disclosed in the prior art. Another object of the present invention is to provide a carrying device that does not have to be removed and separately stored while skiing.

BRIEF DESCRIPTION OF THE DRAWING

The present invention can be more readily understood in conjunction with the accompanying drawings, in which.

DETAILED DESCRIPTION OF THE INVENTION

Figure 1:
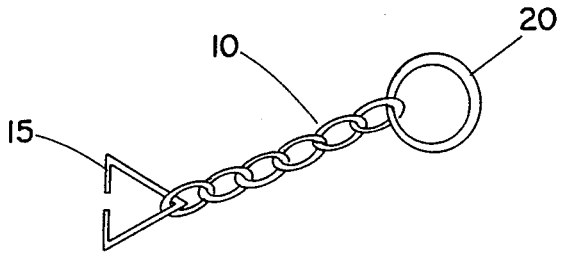
FIG. 1 is a view of the apparatus comprising the fastener, elongated member, and ring.
Figure 2:
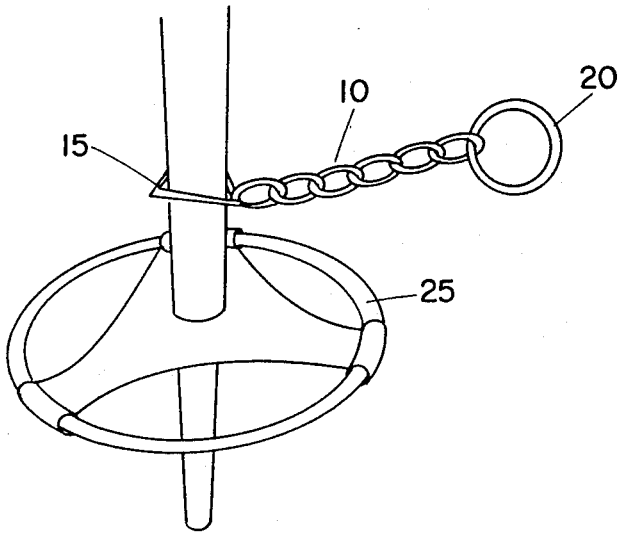
FIG. 2 is a side view of the lower end of a conventional ski pole with the fastener attached around the shaft of the ski pole immediately above the ski pole basket.

FIG. 1 shows the components used to attach together the lower ends of the ski poles. These components are an elongated member 10, a fastener 15 secured to one end of the elongated member, and a ring 20 secured to the other end of the elongated member. The fastener is permanently secured near the lower end of one of the ski poles. In the preferred embodiment, the fastener is a split ring made of a deformable material such as aluminum or mild steel that can be bent or opened with the aid of pliers. The fastener is attached around the shaft of the pole directly above the basket 25, as shown in FIG. 2. The basket serves to hold the fastener on the ski pole. Alternatively, other types of fasteners could be used, such as a clip or a rivet attached either to the basket or shaft of the pole. The elongated member 10 is usually a chain or flexible cord having a length slightly greater than the radius of the ski pole basket. One end of the elongated member is secured to the fastener attached to the first ski pole. The other end is secured to a ring 20 having an inside diameter slightly larger than the tip of the ski poles. During skiing, the ring and elongated member simply dangle from the first ski pole, as shown in FIG. 2. This does not interfere with the skier in any way, due to the short length of the elongated member.

Figure 3:
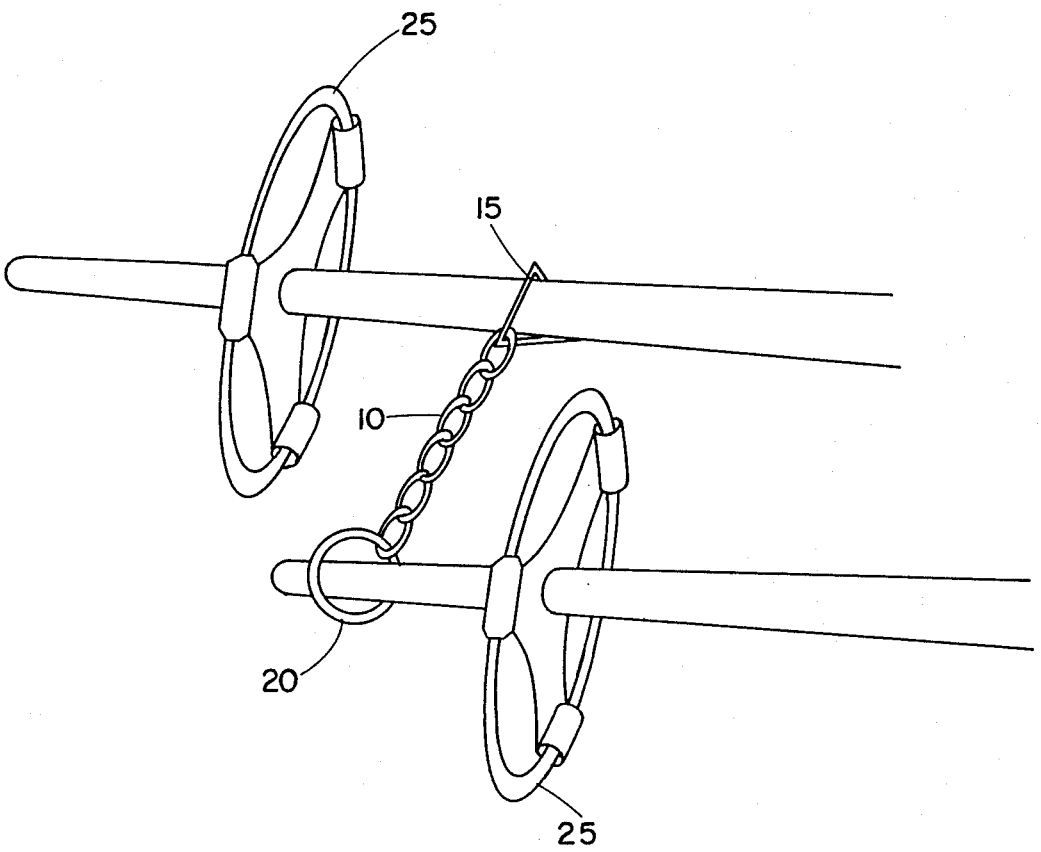
FIG. 3 is a side view of the lower ends of two ski poles, showing the ring slipped over the end of the second ski pole.
Figure 4:
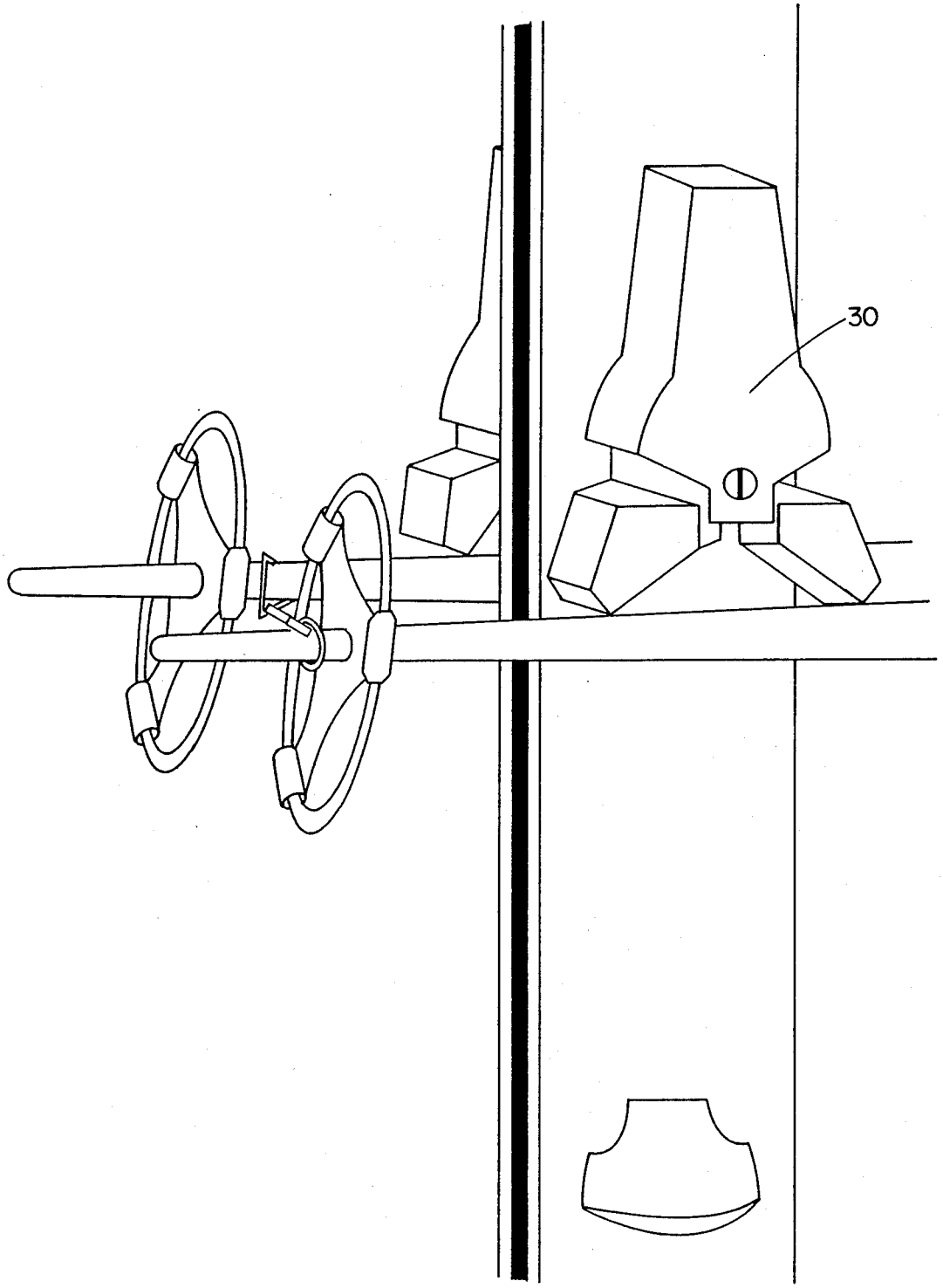
FIG. 4 is a prospective side view showing the ski poles in position under the toe binding of the skis.

To carry the skis and poles, the ring 20 is slipped over the tip of the second pole. Both poles are placed in a substantially parallel orientation with the elongated member extending between the lower ends of the poles, as shown in FIG. 3. The skis are stacked together with their bottom surfaces facing one another, and their bindings facing outward. The skis are placed perpendicularly through the opening between the ski poles until the toe bindings 30 of the skis rest against the ski poles, as shown in FIG. 4.

Many modern ski bindings have a pressure plate or wire loop at the rear of the toe binding as part of the ski brake. While the ski is worn, the ski boot depresses this pressure plate or wire loop against the top surface of the ski, thereby deactivating the brake. However, when the ski boot is removed from the bindings, the pressure plate or wire loop is spring loaded to lift a small distance off the top surface of the ski. In one embodiment, each ski pole shaft is slipped under the pressure plate or wire loop, and wedged against the top surface of the ski. Alternatively, the ski poles can be supported against the portion of the toe bindings that grip the front flange of the ski boots. This alternative may be necessary in those cases where ski brakes are entirely absent, or where the brakes are incorporated as part of the heel bindings.

Figure 5:
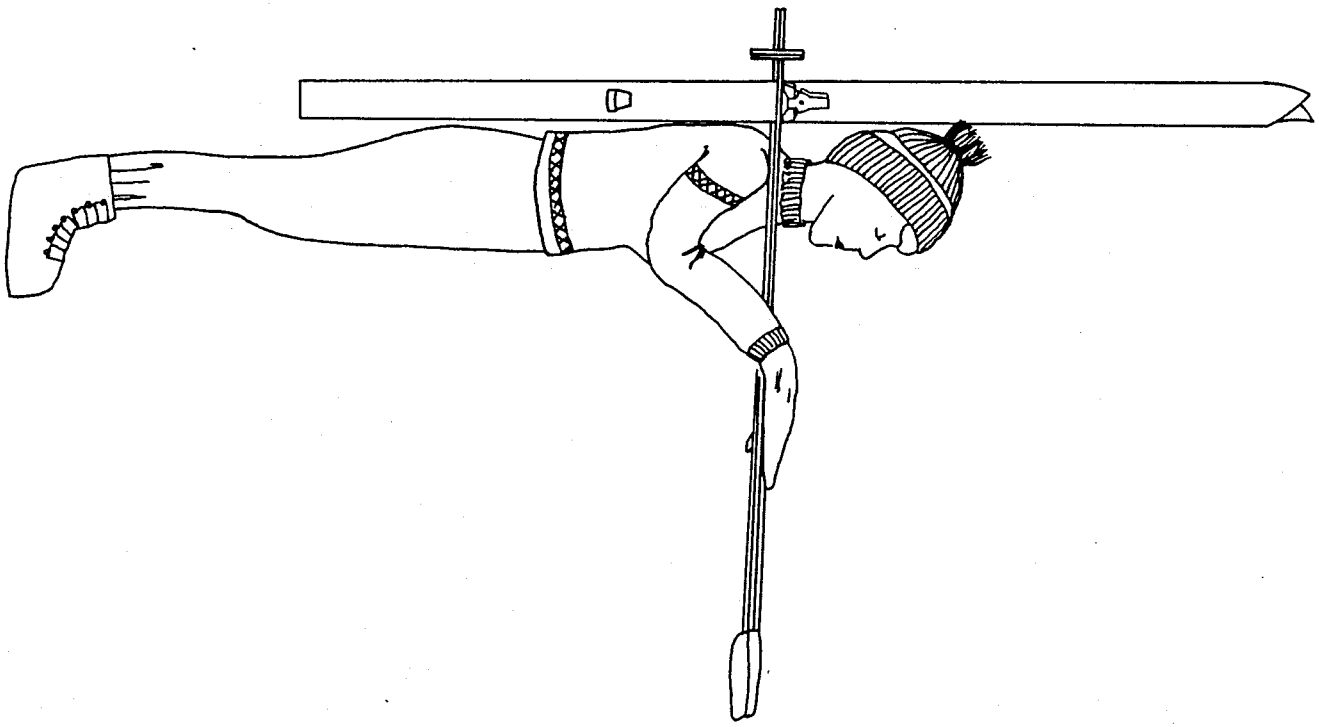
FIG. 5 is a side view showing the completed assembly with the skis and poles being carried by a skier.

The poles are then carried over the shoulder of the skier, with the pole handles extending in front of the skier. The skis are held in a substantially vertical orientation between the back of the skier and the ski pole baskets, as shown in FIG. 5. Vertical support of the skis is provided by the toe bindings of the skis resting on top of the poles. The skier's shoulder acts as the fulcrum. One of the skier's hands grips the poles at a point in front of the skier, exerting a downward force. The ski poles act as levers carrying this as an upward supporting force for the skis. Any desired degree of leverage can be obtained by adjusting the position of the hand grip or the position of the poles with respect to the skier's shoulder.

I claim:

1. A method of carrying a pair of skis and ski poles, both of said skis having a bottom surface, a top surface, and a toe and heel bindings attached to said top surface adapted to removably secure the ski to a ski boot worn by the skier; both of said ski poles having an elongated shaft, a handle attached to the upper end of said shaft, and a basket extending radially outward from said shaft at a predetermined distance from the lower end of said shaft; said method comprising:

(a) securing one end of an elongated member to a first ski pole at a point above the ski pole basket;

(b) removably securing the other end of the elongated member to the lower end of the second ski pole;

(c) establishing a substantially parallel orientation of both ski poles, with the elongated member extending between the ski poles to provide a space between said ski poles;

(d) stacking the pair of skis together, with their bottom surfaces facing one another, and the ski bindings facing outward;

(e) placing the skis perpendicularly through the space between the ski poles, until the toe bindings of the skis rest against the ski poles; and (f) carrying the ski poles over the shoulder of the skier, with the ski pole handles extending in front of the skier, and the skis held in a substantially vertical orientation between the back of the skier and the ski pole baskets.

2. The method of claim, wherein the elongated member is secured to said first ski pole by means of a split ring that is secured around the shaft of the first ski pole above the ski pole basket.

3. The method of claim 1, wherein the elongated member comprises a length of chain.

4. The method of claim 1, wherein the elongated member has a length slightly greater than the radius of the ski pole basket.

* * * * *